US009267402B2

(12) United States Patent
Woo et al.

(10) Patent No.: US 9,267,402 B2
(45) Date of Patent: Feb. 23, 2016

(54) MULTISTAGE VARIABLE VALVE LIFT APPARATUS, SYSTEM AND ENGINE

(71) Applicant: Hyundai Motor Company, Seoul (KR)

(72) Inventors: Soo Hyung Woo, Yongin-si (KR); Jong Hyeok Choi, Hwaseong-si (KR); Young Hong Kwak, Suwon-si (KR); Byong Young Choi, Bucheon-si (KR); Jin Kook Kong, Suwon-si (KR); Gee Wook Shin, Ansan-si (KR)

(73) Assignee: Hyundai Motor Company, Seoul (KR)

( * ) Notice: Subject to any disclaimer, the term of this patent is extended or adjusted under 35 U.S.C. 154(b) by 54 days.

(21) Appl. No.: 14/143,850

(22) Filed: Dec. 30, 2013

(65) Prior Publication Data

US 2014/0261267 A1 Sep. 18, 2014

(30) Foreign Application Priority Data

Mar. 14, 2013 (KR) ..... 10-2013-0027467

(51) Int. Cl.

| | |
|---|---|
| ***F01L 1/34*** | (2006.01) |
| ***F01L 31/16*** | (2006.01) |
| *F01L 1/047* | (2006.01) |
| *F01L 13/00* | (2006.01) |

(52) U.S. Cl.

CPC ..... *F01L 31/16* (2013.01); *F01L 13/0036* (2013.01); *F01L 2001/0473* (2013.01); *F01L 2013/0052* (2013.01); *F01L 2820/031* (2013.01)

(58) Field of Classification Search

CPC ..... F01L 2013/0052; F01L 1/34403; F01L 13/0036; F01L 1/344

USPC ..... 123/90.18

See application file for complete search history.

(56) References Cited

U.S. PATENT DOCUMENTS

| | | | | |
|---|---|---|---|---|
| 4,404,937 | A | 9/1983 | Leitermann | |
| 6,425,359 | B2 | 7/2002 | Fujii et al. | |
| 7,409,938 | B2 * | 8/2008 | Dengler | 123/90.18 |
| 7,472,671 | B2 | 1/2009 | Elendt et al. | |
| 2007/0178731 | A1 | 8/2007 | Elendt | |
| 2010/0242884 | A1 * | 9/2010 | Meintschel et al. | 123/90.21 |
| 2011/0079191 | A1 * | 4/2011 | Lengfeld et al. | 123/90.18 |
| 2011/0226205 | A1 * | 9/2011 | Kraus | 123/90.18 |
| 2014/0137819 | A1 * | 5/2014 | McConville et al. | 123/90.6 |

FOREIGN PATENT DOCUMENTS

| | | | |
|---|---|---|---|
| DE | 42 30 877 | A1 | 4/1993 |
| DE | 101 48 243 | A1 | 4/2003 |
| EP | 0 798 451 | A1 | 1/1997 |
| JP | 2012-167593 | A | 9/2012 |

* cited by examiner

*Primary Examiner* — Jesse Bogue
*Assistant Examiner* — Daniel Bernstein
(74) *Attorney, Agent, or Firm* — Morgan, Lewis & Bockius LLP

(57) ABSTRACT

A multistage variable valve lift apparatus includes: a camshaft; a plurality of cams slidably provided on the camshaft and each including a cam base with a guide projection and a cam lobe; a solenoid unit that includes an operating rod with a guide slot into which the guide projection is selectively inserted; and a valve opening/closing portion that comes into selective contact any one of the plurality of cams.

17 Claims, 6 Drawing Sheets

FIG. 6

| 10 Stages | Lifts on first side of valve | Lifts on second side of lift | Engine modes |
|---|---|---|---|
| 1 | 0 | 0 | CDA |
| 2 | 0 | 2 | Minimum amount of air at idle |
| 3 | 0 | 10 | High swirl |
| 4 | 5 | 0 | Swirl |
| 5 | 5 | 2 | Swirl |
| 6 | 5 | 10 | Swirl |
| 7 | 8 | 0 | High swirl |
| 8 | 8 | 2 | High swirl |
| 9 | 8 | 10 | Performance |
| 10 | 10 | 10 | Performance |

MULTISTAGE VARIABLE VALVE LIFT APPARATUS, SYSTEM AND ENGINE

CROSS-REFERENCE TO RELATED APPLICATION

The present application claims priority of Korean Patent Application Number 10-2013-0027467 filed Mar. 14, 2013, the entire contents of which application is incorporated herein for all purposes by this reference.

BACKGROUND OF INVENTION

1. Field of Invention

The present invention relates to a multistage valve variable valve lift apparatus, a multistage variable valve lift system, and an engine including the same, and more particularly, to a multistage valve variable valve lift apparatus, which is capable of implementing a plurality of valve lift modes, and an engine including the same.

2. Description of Related Art

An internal combustion engine makes power by drawing fuel and air into a combustion chamber and burning the fuel and the air. Intake valves are actuated by a camshaft in order to intake the air, and the air is drawn into the combustion chamber while the intake valves are open. In addition, exhaust valves are operated by the camshaft, and a combustion gas is expelled from the combustion chamber while the exhaust valves are open.

However, an optimal operation of the intake valves and the exhaust valves depends on the rotational speed of the engine. That is, an appropriate lift or valve opening/closing time depends on the rotational speed of the engine. As such, in order to implement the appropriate valve operation depending on the rotational speed of the engine, research has been undertaken on a variable valve lift (VVL) apparatus in which cams driving the valves is designed to have a plurality of shapes or the valves operate at different lifts according to the number of rotations of the engine.

The information disclosed in this Background section is only for enhancement of understanding of the general background of the invention and should not be taken as an acknowledgement or any form of suggestion that this information forms the prior art already known to a person skilled in the art.

BRIEF SUMMARY

Various aspects of the present invention provide for a multistage variable valve lift apparatus, a multistage variable valve lift system, and an engine including the same, which can implement a plurality of valve lift modes.

Various aspects of the present invention provide for a multistage variable valve lift apparatus including: a camshaft; a plurality of cams slidably provided on the camshaft and each including a cam base with a guide projection and a cam lobe; a solenoid unit that includes an operating rod with a guide slot into which the guide projection is selectively inserted; and a valve opening/closing portion that comes into selective contact any one of the plurality of cams.

The plurality of cams, the solenoid unit, and the valve opening/closing portion may constitute a single variable valve unit, and two variable valve units may be provided for each cylinder.

Each of the variable valve units provided in the cylinder may have a different number of cams.

The cam lobes of the variable valve unit may have different lifts and be arranged in order of size.

At least one of the cam lobes of the cams for the variable valve unit provided for each cylinder and any one of the cam lobes of another variable valve unit may have different lifts.

Any one of the cam lobes of the variable valve unit may have a lift of '0'.

Either one of the variable valve units provided in each cylinder may operate independently of the other variable valve unit.

The guide projection may be inclined so as to connect the cam bases of the neighboring cams, and each guide projection may include an operating guide projection adapted to move the cams in one direction and a reverse guide projection formed in the opposite direction of the operating guide projection.

A diamond-shaped crossover projection may be formed at the point where the operating guide projection and the reverse guide projection cross each other.

at one cam disposed to an end of the variable valve unit, the start position of the operating guide projection and the end position of the reverse guide projection may be on the same circumference, and at one cam disposed to an end, the end position of the operating guide projection and the start position of the reverse guide projection may be on the same circumference.

The start position of the operating guide projection of the guide projection formed on the cam provided on the inner side of the variable valve unit and the end positions of the other guide projections may be on the same circumference, and the start position of the reverse guide projection of the same and the end positions of the other reverse guide projections may be on the same circumference, wherein the two circumferences may be different.

The valve opening/closing portion may include a roller that comes into contact with the cams.

Various aspects of the present invention provide for a multistage variable valve lift system including: a camshaft; a plurality of cams slidably provided on the camshaft and each including a cam base with a guide projection and a cam lobe; a solenoid unit that includes an operating rod with a guide slot into which the guide projection is selectively inserted; and a valve opening/closing portion that comes into selective contact with any one of the plurality of cams, wherein the plurality of cams, the solenoid unit, and the valve opening/closing portion may constitute a single variable valve unit, and two variable valve units may be provided for each cylinder Each of the variable valve units provided in the cylinder may have a different number of cams.

Either one of the variable valve units provided in each cylinder may operate independently of the other variable valve unit.

The guide projection may be inclined so as to connect the cam bases of the neighboring cams, and each guide projection may include an operating guide projection adapted to move the cams in one direction and a reverse guide projection formed in the opposite direction of the operating guide projection.

A diamond-shaped crossover projection may be formed at the point where the operating guide projection and the reverse guide projection cross each other.

at one cam disposed to an end of the variable valve unit, the start position of the operating guide projection and the end position of the reverse guide projection may be on the same circumference, and at one cam disposed to the other end of the variable valve unit, the end position of the operating guide projection and the start position of the reverse guide projection may be formed on the same circumference.

The start position of the operating guide projection of the guide projection formed on the cam provided on the inner side of the variable valve unit and the end positions of the other guide projections may be on the same circumference, and the start position of the reverse guide projection of the same and the end positions of the other reverse guide projections may be on the same circumference, wherein the two circumferences may be different.

An engine according to various aspects of the present invention may be equipped with the multistage variable valve lift apparatus according to the exemplary embodiment of the present invention or the multistage variable valve lift system according to the exemplary embodiment of the present invention.

A multistage variable valve lift apparatus, system and engine according to various aspects of the present invention can achieve a plurality of valve lift modes by a simple configuration.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 6 is a view showing an operation mode of an exemplary multistage variable valve lift apparatus according to the present invention.

DETAILED DESCRIPTION

Figure 1:
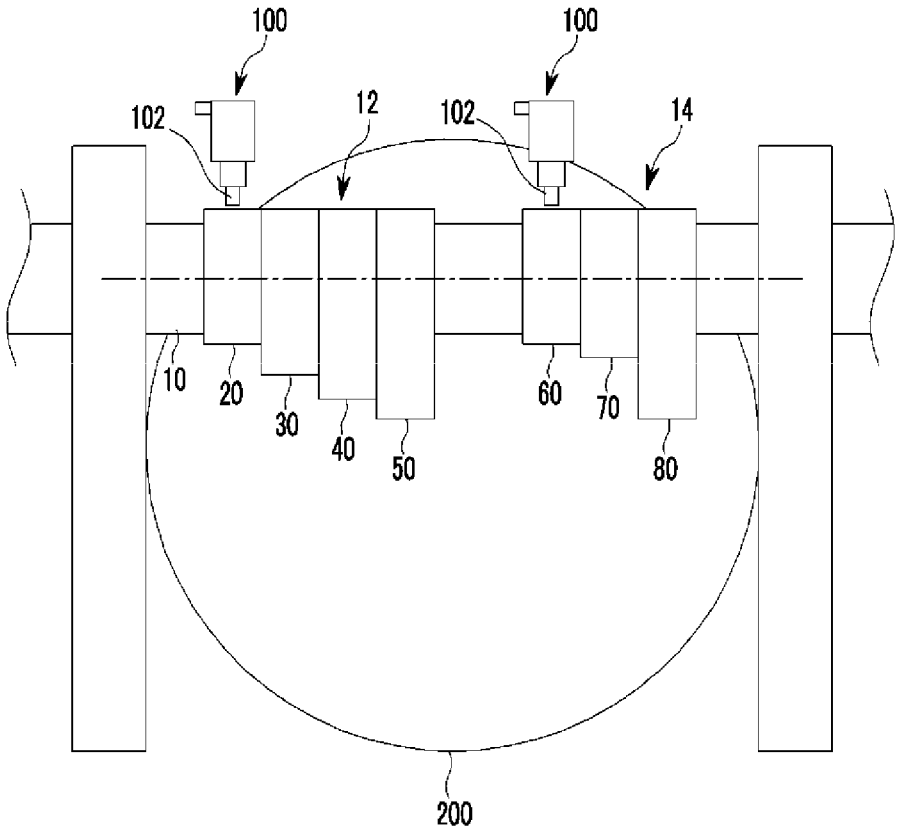
FIG. 1 is a view showing an exemplary multistage variable valve lift apparatus according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Throughout the specification, like reference numerals designate like elements.

In the drawings, the thickness of layers, films, panels, regions, etc., are exaggerated for clarity.

It will be understood that when an element such as a layer, film, region, or substrate is referred to as being "on" another element, it can be directly on the other element or intervening elements may also be present.

In contrast, when an element is referred to as being "directly on" another element, there are no intervening elements present.

Throughout the specification, unless explicitly described to the contrary, the word "comprise" and variations such as "comprises" or "comprising", will be understood to imply the inclusion of stated elements but not the exclusion of any other elements.

Various embodiments of the present invention will hereinafter be described in detail with reference to the accompanying drawings.

Figure 2:
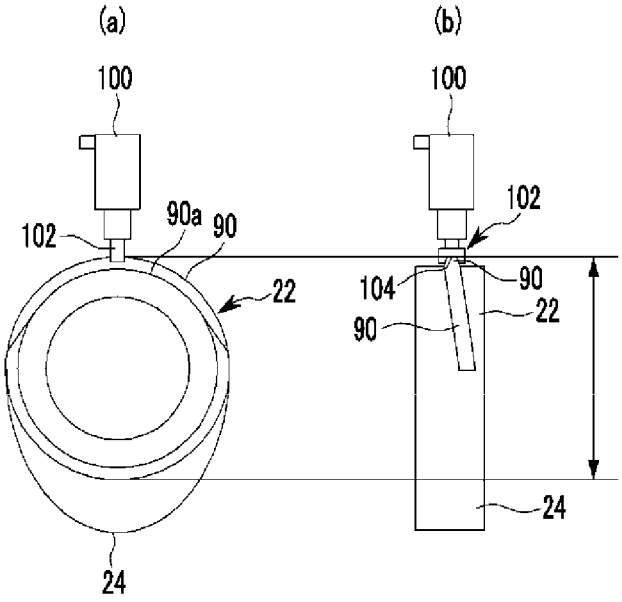
FIG. 2 is a view showing a cam and a solenoid unit in an exemplary multistage variable valve lift apparatus according to the present invention.

FIG. 1 is a view showing a multistage variable valve lift apparatus according to various embodiments of the present invention. FIG. 2 is a view showing a cam and a solenoid unit in a multistage variable valve lift apparatus according to various embodiments of the present invention.

Figure 3:
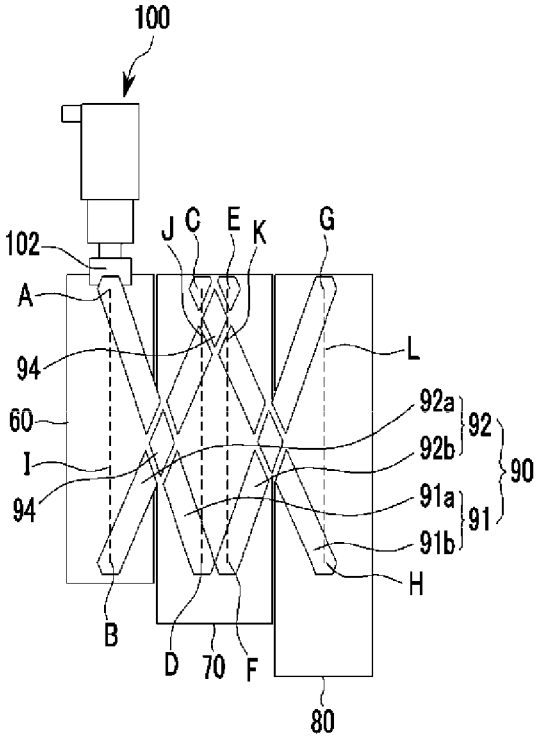
FIG. 3 is a view showing cams and a solenoid unit in an exemplary multistage variable valve lift apparatus according to the present invention.
Figure 4:
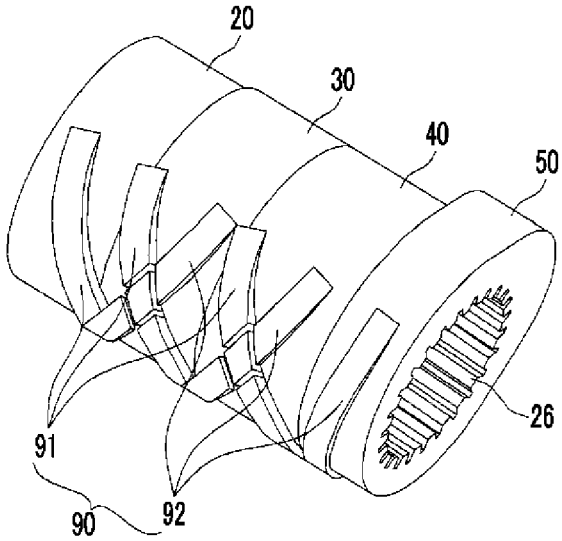
FIG. 4 is a perspective view showing cams of an exemplary multistage variable valve lift apparatus according to the present invention.

FIG. 3 is a view showing cams and a solenoid unit in a multistage variable valve lift apparatus according to various embodiments of the present invention. FIG. 4 is a perspective view showing cams of a multistage variable valve lift apparatus according to various embodiments of the present invention.

Figure 5:
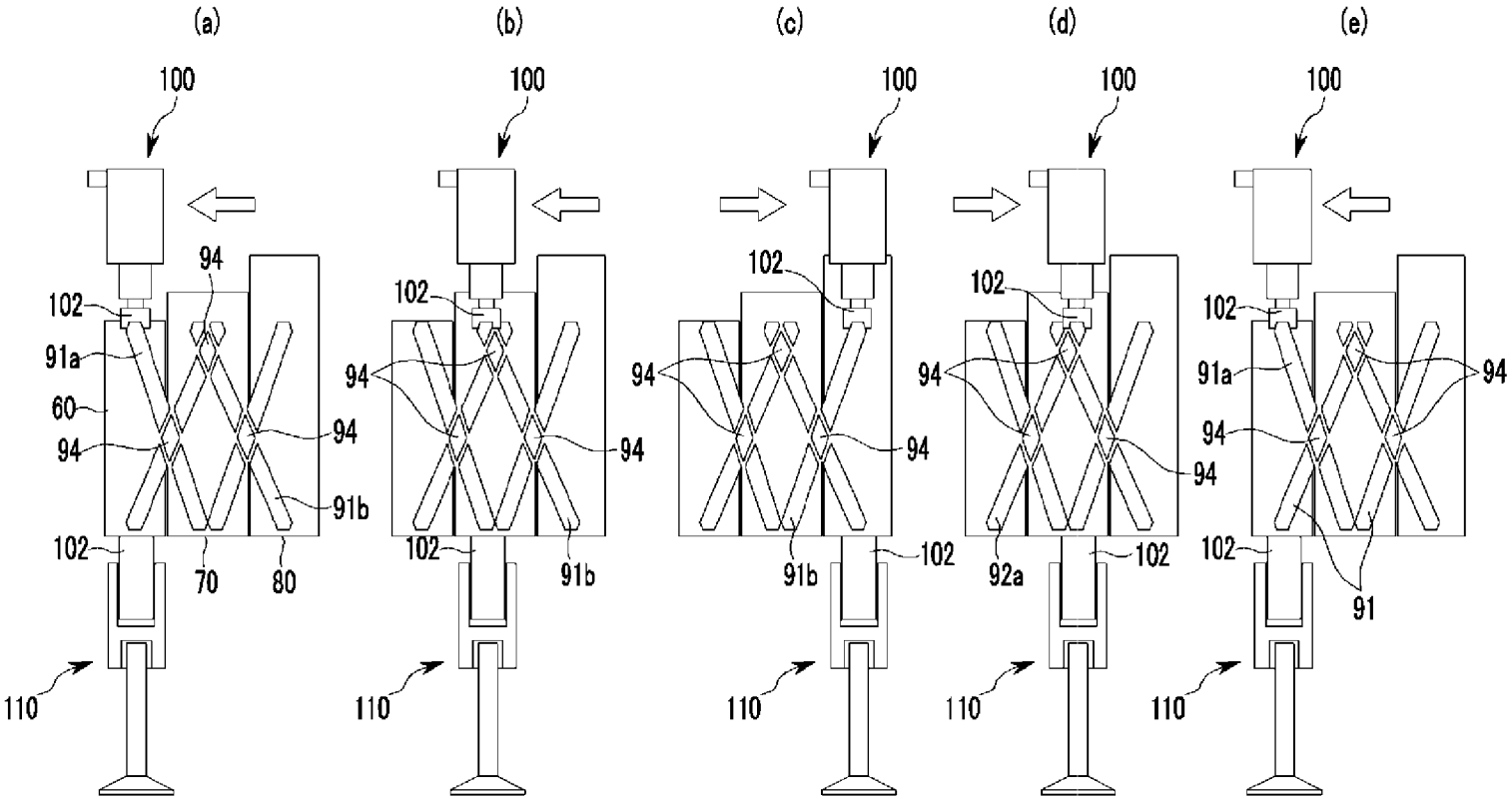
FIG. 5(*a*), FIG. 5(*b*), FIG. 5(*c*), FIG. 5(*d*) and FIG. 5(*e*) are views showing an operation of an exemplary multistage variable valve lift apparatus according to the present invention.

Referring to FIGS. 1 to 4, a multistage variable valve lift apparatus according to various embodiments of the present invention may include a camshaft 10, a plurality of cams 20, 30, 40, 50, 60, 70, and 80 slidably provided on the camshaft 10, and each including a cam base 22 with a guide projection 90 and a cam lobe 24, a solenoid unit 100 that includes an operating rod 102 with a guide slot and into which the guide projection 90 is selectively inserted, and a valve opening/closing portion 110 (see, e.g., FIGS. 5(*a*)-(*e*)) that comes into selective contact any one of the plurality of cams 20, 30, 40, 50, 60, 70, and 80.

For better comprehension and ease of description, the cams will be referred to as first, second, third, fourth, fifth, sixth, and seventh cams 20, 30, 40, 50, 60, 70, and 80.

Taking one cam 20 of FIG. 2 as an example, the guide projection 90 is formed on the cam base 22, and when the solenoid unit 100 is actuated to cause the operating rod 102 to be engaged with the guide projection 90 of the rotating cam 20, the cam 20 slides along the longitudinal direction of the cam shaft 10. The operating rod 102 returns to the original position at an end of the rotating guide projection 90.

The guide projection 90 forms a base circle of the cam base 22, an inner circle 90*a* is formed with a diameter less than that of the cam base 22, and both ends of the inner circle 90*a* are connected to the guide projection 90. Accordingly, when the operating rod 102 is positioned on one end of the guide projection 90, the end of the inner circle 90*a* causes the operating rod 102 to be inserted into the solenoid unit 100.

The plurality of cams 20, 30, 40, 50, 60, 70, and 80, the solenoid unit 100, and the valve opening/closing portion 110 constitute a single variable valve unit 12 and 14, and two variable valve units 12 and 14 may be provided for each cylinder. That, as shown in FIG. 1, a first variable valve unit 12 and a second variable valve unit 14 may be provided in a cylinder 200.

Either one of the variable valve units provided in each cylinder 200 may operate independently of the other variable valve unit. That is, the first variable valve unit 12 and the second variable valve unit 14 may not operate in the same way, but instead only one variable valve unit may operate or both of the first and second variable valve units 12 and 14 may operate simultaneously, depending on the operating state of the engine.

FIG. 3 shows the second variable valve unit 14.

Taking the second variable valve unit 14 of FIG. 3 as an example, the guide projection 90 is inclined so as to connect the cam bases of the neighboring fifth, sixth, and seventh cams 60, 70, and 80, and each guide projection 90 includes an operating guide projection 91 adapted to move the fifth, sixth, and seventh cams 60, 70, and 89 in one direction and a reverse guide projection 92 formed in the opposite direction of the operating guide projection 91.

A diamond-shaped crossover projection 94 is formed at the point where the operating guide projection 91 and the reverse guide projection 92 cross each other so that the operating rod 102 is kept engaged with the operating guide projection 91 or the reverse guide projection 92 while moving.

A first operating guide projection 91*a* is formed to connect the fifth and sixth cams 60 and 70, and a second operating guide projection 91*b* is formed to connect the sixth and seventh cams 70 and 80.

Also, a first reverse guide projection 92*a* is formed to connect the fifth and sixth cams 60 and 70, and a second reverse guide projection 92*b* is formed to connect the sixth and seventh cams 70 and 80.

At one cam disposed to an end of the variable valve unit, the start position of the operating guide projection and the end position of the reverse guide projection may be on the same circumference, and at one cam disposed to the other end of the variable valve unit, the end position of the operating guide projection and the start position of the reverse guide projection may be on the same circumference.

That is, taking the cams of FIG. 3 as an example, the cams on either side are the fifth and seventh cams 60 and 80, the start position A of the first operating guide projection 91*a* and the end position B of the reverse guide projection 92*a* may be on the same circumference I, and the end position H of the second guide projection 91*b* and the start position G of the second reverse guide projection 92*b* may be on the same circumference L.

The start position of the operating guide projection of the guide projection formed on the cam provided on the inner side of the variable valve unit and the end positions of the other guide projections are on the same circumference, and the start position of the reverse guide projection of the same and the end positions of the other reverse guide projections are on the same circumference. The two circumferences are different.

That is, taking the cams of FIG. 3 as an example, the cam on the inner side, the start position C of the second operating guide projection 91*b* and the end position D of the first operating guide projection 91*a* may be on the same circumference J, and the start position E of the first reverse guide projection 92*a* and the end position F of the second reverse guide projection 92*b* may be on the same circumference K, and the circumferences J and K are different.

The variable valve units 12 and 14 provided in the cylinder 200 each may have a different number of cams. That is, as shown in FIG. 1, the first variable valve unit 12 may include the first, second, third, and fourth cams 20, 30, 40, and 50 each having a different cam lobe, and the second variable valve unit 14 may include the fifth, sixth, and seventh cams 60, 70, and 80 each having a different cam lobe. However, it should be noted that the number of cams is not limited thereto, and different numbers of cams may be provided depending on the size of the cylinder, the sizes of the variable valve units, etc.

The cam lobes of the variable valve units 12 and 14 may have different lifts and be arranged in order of size. That is, as shown in FIG. 1, the lobe of each cam may have an each lift so as to achieve variable lift, and be sequentially arranged depending on the sizes of the lobes.

At least one of the cam lobes of the cams for the variable valve unit 12 or 14 provided for each cylinder and any one of the cam lobes of the other variable valve unit may have different lifts. For example, a cam lobe of the first variable valve unit 12 and any one of the cam lobes of the second variable valve unit 14 have different lifts.

Any one of the cam lobes of the variable valve unit may have a lift of '0', and this enables a cylinder deactivation (CDA) function.

As shown in FIGS. 5(*a*)-(*e*), the valve opening/closing portion 110 may include a roller that comes into contact with the cams. As the cams are moved by actuating the solenoid unit 100, the roller 102 comes into contact with any one of the cams.

Below, the operation of the multistage variable valve lift apparatus according to various embodiments of the present invention will be described with reference to FIGS. 1 to 5.

An engine control unit (ECU) selects an operation mode of the variable valve lift apparatus depending on the operating state of the engine and controls the operation of the solenoid unit 100 in the selected mode.

The configuration and operation of the ECU, including the operation mode of the variable valve lift apparatus depending on the operating state of the engine are well known to those skilled in the art, so detailed description thereof will be omitted.

Referring to FIG. 3 and FIGS. 5(*a*)-(*e*), as the roller 102 come into contact with the fifth cam 50 to cause the fifth cam 60 to rotate, the valve opening/closing portion 110 is opened or closed.

When the solenoid unit 100 is actuated, the operating rod 102 is engaged with the start position A of the first operating guide projection 91*a* and removed from the end position D of the first operating guide projection 91*a*, as shown in FIG. 5(*a*).

Then, the fifth, sixth, and seventh cams 60, 70, and 80 move on the camshaft 10 in the direction of the arrow indicated in the drawing.

At this time, when the solenoid unit 100 is actuated, the operating rod 102 is engaged with the start position C of the second operating guide projection 91*b* and removed from the end position H of the second operating guide projection 91*b*, as shown in FIG. 5(*b*).

Then, the fifth, sixth, and seventh cams 60, 70, and 80 move on the camshaft 10 in the direction of the arrow indicated in the drawing.

At this time, when the solenoid unit 100 is actuated, the operating rod 102 is engaged with the start position G of the second reverse guide projection 92*b* and removed from the end position F of the second reverse guide projection 92*b*, as shown in FIG. 5(*c*).

Then, the fifth, sixth, and seventh cams 60, 70, and 80 move on the camshaft 10 in the direction of the arrow indicated in the drawing.

At this time, when the solenoid unit 100 is actuated, the operating rod 102 is engaged with the start position E of the first reverse guide projection 92*a* and removed from the end position B of the first reverse guide projection 92*a*, as shown in FIG. 5(*d*).

Then, the fifth, sixth, and seventh cams 60, 70, and 80 move on the camshaft 10 in the direction of the arrow indicated in the drawing, and become as shown in FIG. 5(*e*).

Hereinafter, the variable valve lift apparatus will repeat the above-explained operation depending on the operating state of the engine.

FIG. 6 is a view showing an operation mode of a multistage variable valve lift apparatus according to various embodiments of the present invention.

If the variable valve units 12 and 14 each have the first, second, third, and fourth cams 20, 30, 40, and 50 and the fifth, sixth, and seventh cams 60, 70, and 80, and for example, the first, second, third, and fourth cams 20, 30, 40, 50 have lifts of 0, 5, 8, and 10 mm and the fifth, sixth, and seventh cams 60, 70, and 80 have lifts of 0, 2, and 10 mm, the variable units 12 and 14 can achieve 10 valve lift modes.

That is, a variety of operation modes, including a cylinder deactivation (CDA) mode, an idle mode, a swirl mode, and a high-swirl mode, can be achieved depending on how the operations of the variable valve units 12 and 14 are combined.

As the multistage variable valve lift apparatus according to various embodiments of the present invention includes the guide projection formed on the cam base to vary valve lifts, the multistage variable valve lift apparatus can be made compact. Accordingly, various operation modes can be achieved, compared to cylinder size, thereby improving the fuel efficiency of the engine and enhancing engine performance.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A multistage variable valve lift apparatus comprising:
- a camshaft;
- a plurality of cams slidably provided on the camshaft and each including a cam base with a guide projection and a cam lobe;
- a solenoid unit that comprises an operating rod with a guide slot into which the guide projection is selectively inserted; and
- a valve opening/closing portion that comes into selective contact any one of the plurality of cams,
- wherein the plurality of cams, the solenoid unit, and the valve opening/closing portion constitute a single variable valve unit,
- wherein two variable valve units are provided for each cylinder, and
- wherein each of the variable valve units provided in the cylinder has a different number of cams.

2. The multistage variable valve lift apparatus of claim 1, wherein the cam lobes of the variable valve unit have different lifts and are arranged in order of size.

3. The multistage variable valve lift apparatus of claim 1, wherein at least one of the cam lobes of the cams for the variable valve unit provided for each cylinder and any one of the cam lobes of another variable valve unit have different lifts.

4. The multistage variable valve lift apparatus of claim 1, wherein any one of the cam lobes of the variable valve unit has a lift of '0'.

5. The multistage variable valve lift apparatus of claim 1, wherein either one of the variable valve units provided in each cylinder operates independently of the other variable valve unit.

6. The multistage variable valve lift apparatus of claim 1, wherein the valve opening/closing portion comprises a roller that comes into contact with the cams.

7. An engine equipped with the multistage variable valve lift apparatus of claim 1.

8. A multistage variable valve lift apparatus comprising:
- a camshaft;
- a plurality of cams slidably provided on the camshaft and each including a cam base with a guide projection and a cam lobe;
- a solenoid unit that comprises an operating rod with a guide slot into which the guide projection is selectively inserted; and
- a valve opening/closing that comes into selective contact any one of the plurality of cams,
- wherein the plurality of cams, the solenoid unit, and the valve opening/closing portion constitute a single variable valve unit,
- wherein two variable valve units are provided for each cylinder,
- wherein the guide projection is inclined so as to connect the cam bases of the neighboring cams, and
- wherein each guide projection comprises an operating guide projection adapted to move the cams in one direction and a reverse guide projection formed in the opposite direction of the operating guide projection.

9. The multistage variable valve lift apparatus of claim 8, wherein a diamond-shaped crossover projection is formed at the point where the operating guide projection and the reverse guide projection cross each other.

10. The multistage variable valve lift apparatus of claim 8, wherein:
- at least one cam disposed at an end of the variable valve unit, the start position of the operating guide projection and the end position of the reverse guide projection are on the same circumference; and
- at least one cam disposed at the other end of the variable valve unit, the end position of the operating guide projection and the start position of the reverse guide projection are on the same circumference.

11. The multistage variable valve lift apparatus of claim 8, wherein:
- the start position of the operating guide projection of the guide projection formed on the cam provided on the inner side of the variable valve unit and the end positions of the other guide projections are on the same circumference; and
- the start position of the reverse guide projection of the same and the end positions of the other reverse guide projections are on the same circumference;
- wherein the two circumferences are different.

12. A multistage variable valve lift system comprising:
- a camshaft;
- a plurality of cams slidably provided on the camshaft and each including a cam base with a guide projection and a cam lobe;
- a solenoid unit that comprises an operating rod with a guide slot into which the guide projection is selectively inserted; and
- a valve opening/closing portion that comes into selective contact with any one of the plurality of cams, wherein the plurality of cams, the solenoid unit, and the valve opening/closing portion constitute a single variable valve unit, wherein two variable valve units are provided for each cylinder, and wherein each of the variable valve units provided in the cylinder has a different number of cams.

13. The multistage variable valve lift system of claim 12, wherein the cam lobes of the variable valve unit have different lifts and are arranged in order of size.

14. A multistage variable valve lift system comprising:

a camshaft;

a plurality of cams slidably provided on the camshaft and each including a cam base with a guide projection and a cam lobe;

a solenoid unit that comprises an operating rod with a guide slot into which the guide projection is selectively inserted; and a valve opening/closing portion that comes into selective contact with any one of the plurality of cams, wherein the plurality of cams, the solenoid unit, and the valve opening/closing portion constitute a single variable valve unit, wherein two variable valve units are provided for each cylinder, wherein the guide projection is inclined so as to connect the cam bases of the neighboring cams, and wherein each guide projection comprises an operating guide projection adapted to move the cams in one direction and a reverse guide projection formed in the opposite direction of the operating guide projection.

15. The multistage variable valve lift system of claim 14, wherein a diamond-shaped crossover projection is formed at the point where the operating guide projection and the reverse guide projection cross each other.

16. The multistage variable valve lift system of claim 14, wherein:

at least one cam disposed at an end of the variable valve unit, the start position of the operating guide projection and the end position of the reverse guide projection are on the same circumference; and at least one cam disposed at the other end of the variable valve unit, the end position of the operating guide projection and the start position of the reverse guide projection are formed on the same circumference.

17. The multistage variable valve lift system of claim 14, wherein:

the start position of the operating guide projection of the guide projection formed on the cam provided on the inner side of the variable valve unit and the end positions of the other guide projections are on the same circumference; and the start position of the reverse guide projection of the same and the end positions of the other reverse guide projections are on the same circumference;

wherein the two circumferences are different.

* * * * *